US008763335B2

(12) United States Patent
Krieger

(10) Patent No.: US 8,763,335 B2
(45) Date of Patent: Jul. 1, 2014

(54) WAINSCOTING SYSTEM

(75) Inventor: Kevin Krieger, New Philadelphia, OH (US)

(73) Assignee: Marlite, Inc., Dover, OH (US)

( * ) Notice: Subject to any disclaimer, the term of this patent is extended or adjusted under 35 U.S.C. 154(b) by 0 days.

(21) Appl. No.: 13/422,076

(22) Filed: Mar. 16, 2012

(65) Prior Publication Data

US 2013/0239505 A1 Sep. 19, 2013

(51) Int. Cl.
*E04B 2/00* (2006.01)

(52) U.S. Cl.
USPC ..... 52/506.01; 52/590.2; 52/455; 52/311.2

(58) Field of Classification Search
USPC ..... 52/506.06, 506.08, 506.1, 311.2, 586.1, 52/586.2, 589.1, 590.1, 455, 457, 458, 52/506.01, 590.2
See application file for complete search history.

(56) References Cited

U.S. PATENT DOCUMENTS

| | | | | | |
|---|---|---|---|---|---|
| 1,691,803 | A * | 11/1928 | Gray | 52/578 |
| 1,847,121 | A * | 3/1932 | Loetscher | 52/780 |
| 2,000,897 | A * | 5/1935 | Alcott | 52/592.1 |
| 2,825,099 | A * | 3/1958 | Simmons | 52/455 |
| 4,367,614 | A * | 1/1983 | Warwick | 52/455 |
| 4,449,346 | A | 5/1984 | Tremblay | |
| 4,891,920 | A * | 1/1990 | Pingston | 52/145 |
| 5,623,800 | A * | 4/1997 | Shinkosky | 52/468 |
| 5,894,701 | A * | 4/1999 | Delorme | 52/801.11 |
| 6,341,461 | B1 | 1/2002 | Crowley et al. | |
| 6,374,562 | B1 | 4/2002 | Crowley | |
| 6,601,359 | B2 * | 8/2003 | Olofsson | 52/588.1 |
| 6,751,915 | B2 | 6/2004 | Crowley | |
| 6,823,638 | B2 * | 11/2004 | Stanchfield | 52/588.1 |
| 7,150,135 | B2 * | 12/2006 | Becker | 52/592.1 |
| 7,559,179 | B2 * | 7/2009 | Stanchfield | 52/592.1 |
| 7,987,648 | B1 * | 8/2011 | Ryan | 52/506.06 |
| 8,117,795 | B2 * | 2/2012 | Knauseder | 52/592.2 |
| 8,176,701 | B2 * | 5/2012 | Cullen | 52/519 |

(Continued)

FOREIGN PATENT DOCUMENTS

| | | | | |
|---|---|---|---|---|
| EP | 0621383 | | 6/1997 | |
| GB | 2237040 | A * | 4/1991 | E04F 13/08 |
| WO | WO 9004073 | A1 * | 4/1990 | E04F 13/10 |

OTHER PUBLICATIONS

"Classic Modern Wainscot Wall Panel Systems"; New England Classic; archived Feb. 7, 2012; p. 2.

(Continued)

*Primary Examiner* — Brent W Herring
(74) *Attorney, Agent, or Firm* — Wegman, Hessler & Vanderburg

(57) ABSTRACT

A wainscoting system for covering a portion of a wall, wherein the wainscoting system includes a lower rail secured to the wall, a chair rail assembly attached to the wall and spaced apart from the lower rail, a plurality of decorative panels extending between the lower rail and chair rail assembly, and a batten positioned adjacent decorative panels. The batten includes a compound tongue formed into a first side edge thereof and a compound tongue formed into an opposing second side edge thereof. Each decorative panel includes a compound tongue formed into a first side edge thereof and a compound groove formed into an opposing second side edge thereof. The compound tongue of each decorative panel corresponds and is engageable with the compound groove of the batten, and the compound groove of each decorative panel corresponds and is engageable with the compound tongue of the batten.

19 Claims, 10 Drawing Sheets

(56) References Cited

U.S. PATENT DOCUMENTS

| | | | | |
|---|---|---|---|---|
| 2003/0154684 | A1* | 8/2003 | Becker | 52/592.1 |
| 2004/0040250 | A1 | 3/2004 | Bower et al. | |
| 2004/0148893 | A1 | 8/2004 | Kornfalt | |
| 2006/0070329 | A1* | 4/2006 | Schiltz | 52/506.01 |
| 2006/0260247 | A1* | 11/2006 | Monteer | 52/520 |
| 2007/0107349 | A1* | 5/2007 | Erker | 52/455 |
| 2007/0193219 | A1* | 8/2007 | Corriveau | 52/782.1 |
| 2007/0261353 | A1* | 11/2007 | Cullen | 52/590.2 |
| 2009/0249721 | A1* | 10/2009 | Cullen | 52/309.3 |
| 2010/0024341 | A1* | 2/2010 | Stanchfield | 52/588.1 |
| 2010/0088987 | A1* | 4/2010 | Monteer | 52/302.6 |
| 2011/0277409 | A1* | 11/2011 | Atkinson | 52/387 |

OTHER PUBLICATIONS

International Search Report and Written Opinion dated Mar. 26, 2013 for corresponding International Application No. PCT/US13/21095.

* cited by examiner

WAINSCOTING SYSTEM

FIELD OF THE INVENTION

The present invention relates to decorative wall coverings, and more particularly, to installable wainscoting to cover a portion of a wall surface.

BACKGROUND OF THE INVENTION

Wall panel systems for providing a decorative appearance for a wall and the like are well known in the art. In particular, wall panel systems configured as wainscoting are also commonly known in the art. Typical wainscoting systems include a top and bottom rail having a plurality of panels extending therebetween, wherein the bottom rail is positioned adjacent to the floor and the top rail is positioned above the bottom rail but is only positioned a small distance in the vertical direction of the vertical wall. At least one of the top and bottom rails is configured to engage the panels to secure the adjacent panels as well as provide structural framework for the panels.

Typical wainscoting systems also include a chair rail or cap attached to the top rail. In other embodiments, the chair rail is integrally formed with the top rail to provide an upper aesthetic edge to the system. Wainscoting systems typically include a plurality of panels that are arranged along the length of a wall, and the panels are typically either engaged with each to provide a continuous surface along the wall. Wainscoting systems may also include separators positioned between adjacent panels or between adjacent groups of panels, wherein the separators extend between the upper and lower rails to visually divide the panels into smaller lateral sections.

BRIEF SUMMARY OF THE INVENTION

According to one aspect of the present invention, a wainscoting system is provided. The wainscoting system includes a lower rail fixedly attached to a wall, wherein the lower rail includes a groove. The wainscoting system also includes a chair rail trim fixedly attached to the wall, wherein the chair rail trim is spaced apart from the lower rail. The wainscoting system further includes at least two decorative panels, each decorative panel having a compound tongue formed into a first side edge of the decorative panel and a compound groove formed into an opposing second side edge of the decorative panel. The wainscoting system also includes at least one batten, wherein one of the at least one batten is positioned between a pair of decorative panels. The batten has a compound groove formed into a first side edge and a compound groove formed into an opposing second side edge of the batten. The compound tongue of one of the pair of decorative panels engages the compound groove of the batten and the compound groove of the other of the pair of decorative panels engages the compound tongue of the batten. A portion of each of the at least two decorative panels is received within the groove of the lower rail and a portion of each of the at least two decorative panels is received within the groove of the chair rail trim.

According to another aspect of the present invention, wainscoting system for covering a portion of a wall is provided. The wainscoting system includes a lower rail having a groove formed into an upper surface thereof. The wainscoting system also includes a plurality of decorative panels, wherein at least a portion of each of the plurality of decorative panels is received in the groove of the lower rail. At least one batten operatively engages two of the plurality of decorative panels.

The wainscoting system further includes a chair rail trim having a groove formed into a lower surface thereof, wherein at least a portion of each of the plurality of decorative panels is received in the groove of the chair rail trim. A compound tongue formed in the batten is engageable with a corresponding compound groove formed in one of the plurality of decorative panels, and a compound groove formed in the batten is engageable with a corresponding compound tongue formed in another of the plurality of decorative panels.

According to another aspect of the present invention, wainscoting system for covering a portion of a wall is provided. The wainscoting system includes a lower rail having a groove formed into an upper surface thereof. The wainscoting system further includes a first row of decorative panels, wherein at least a portion of each of the plurality of decorative panels of the first row is received in the groove of the lower rail. At least one batten operatively engages two of the plurality of decorative panels of the first row. The wainscoting system includes a first chair rail trim having a lower groove formed into a lower surface thereof and an upper groove formed into an upper surface thereof, wherein at least a portion of each of the plurality of decorative panels of the first row is received in the lower groove of the first chair rail trim. The wainscoting system also includes a second row of decorative panels, wherein at least a portion of each of the plurality of decorative panels of the second row is received in the upper groove of the first chair rail trim. The wainscoting system further includes a second chair rail trim having a lower groove formed into a lower surface thereof, wherein at least a portion of each of the plurality of decorative panels of the second row is received in the lower groove of the second chair rail trim. At least one batten operatively engages two of the plurality of decorative panels of the second row. A compound tongue formed in each of the battens is engageable with a corresponding compound groove formed in one of the plurality of decorative panels adjacent thereto, and a compound groove formed in each of the battens is engageable with a corresponding compound tongue formed in another of the plurality of decorative panels adjacent thereto.

Advantages of the present invention will become more apparent to those skilled in the art from the following description of the embodiments of the invention which have been shown and described by way of illustration. As will be realized, the invention is capable of other and different embodiments, and its details are capable of modification in various respects.

BRIEF DESCRIPTION OF SEVERAL VIEWS OF THE DRAWINGS

These and other features of the present invention, and their advantages, are illustrated specifically in embodiments of the invention now to be described, by way of example, with reference to the accompanying diagrammatic drawings, in which.

Figure 1:
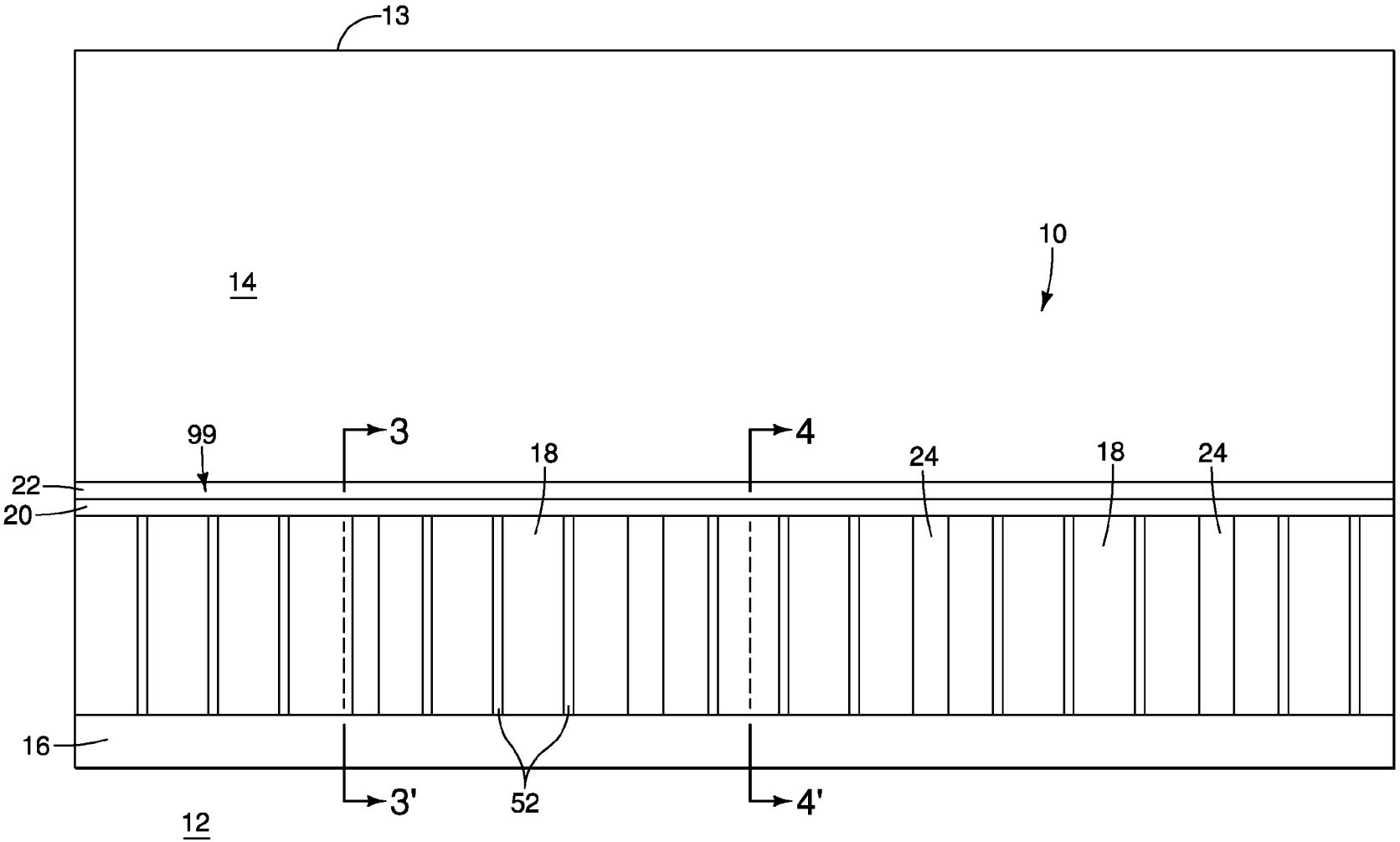
FIG. 1 is a plan view of an embodiment of a wainscoting system installed between a wall and a floor.

It should be noted that all the drawings are diagrammatic and not drawn to scale. Relative dimensions and proportions of parts of these figures have been shown exaggerated or reduced in size for the sake of clarity and convenience in the drawings. The same reference numbers are generally used to refer to corresponding or similar features in the different embodiments. Accordingly, the drawing(s) and description are to be regarded as illustrative in nature and not as restrictive.

DETAILED DESCRIPTION OF THE PREFERRED EMBODIMENT

Figure 2:
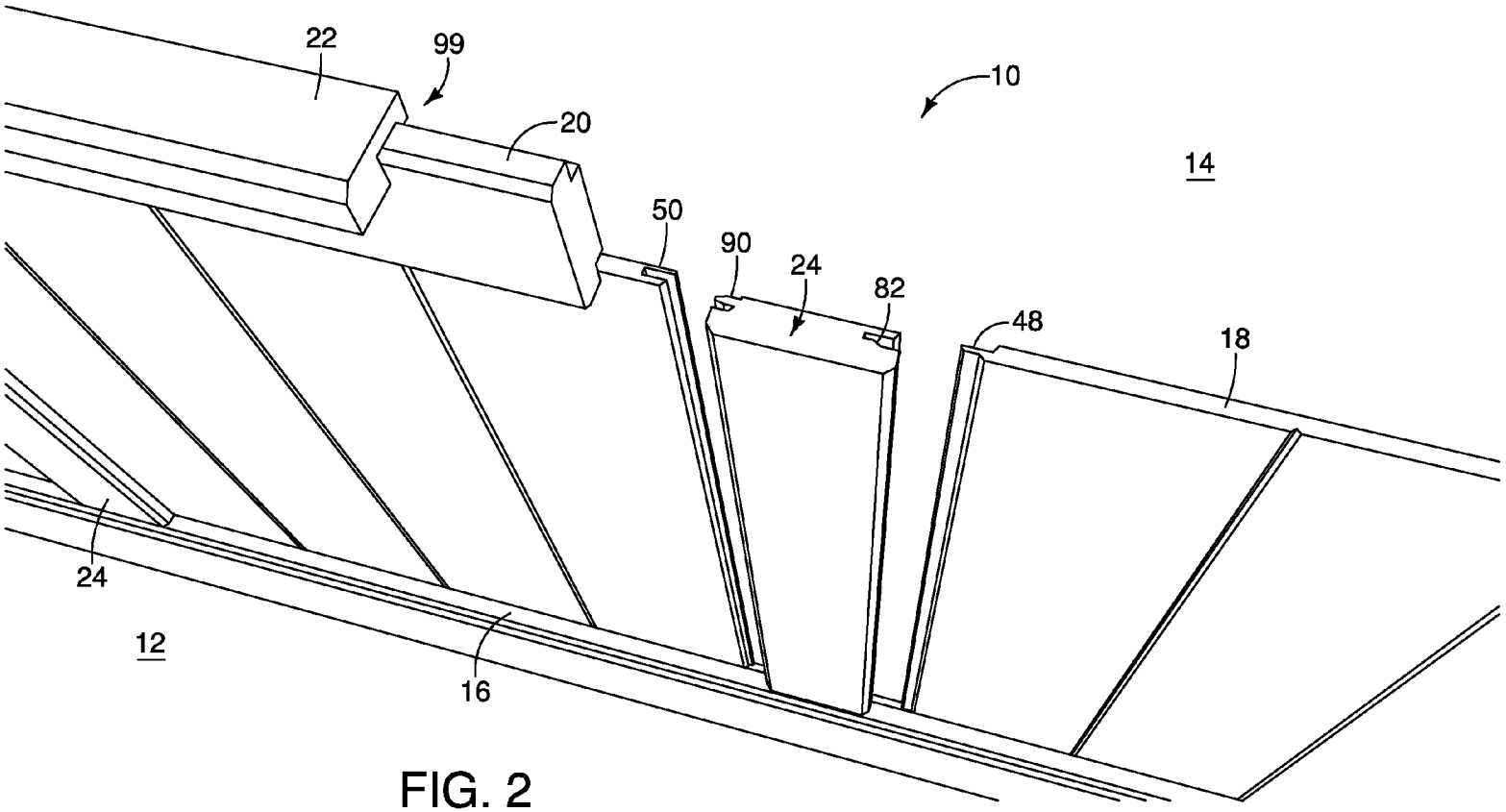
FIG. 2 is perspective view of a portion of the wainscoting system shown in FIG. 1.

Referring to FIGS. 1-2, a wainscoting system 10 for decorating a wall structure is shown extending from the floor 12 and covering the lower portion of a wall 14. The wainscoting system 10 includes a lower rail 16, a plurality of decorative panels 18, a chair rail trim 20, a chair rail cap 22, and at least one batten 24 that is positioned between and engaged with adjacent decorative panels 18. The lower rail 16 extends along a length of the wall 14 adjacent to the floor 12 to provide a base to support the decorative panels 18. The decorative panels 18 are operatively engaged with the lower rail 16. In an embodiment, a batten 24 is positioned between each adjacent decorative panel 18. In another embodiment, a batten 24 is positioned between adjacent sections of decorative panels 18, wherein each section includes one or more decorative panels 18 operatively connected to each other. The battens 24 are configured to engage the decorative panels 18 adjacent thereto. The chair rail trim 20 is positioned adjacent to the wall 14 and oriented in a substantially parallel manner relative to the lower rail 16, wherein the chair rail trim 20 engages the upper edge of each of the decorative panels 18. The chair rail cap 22 is positioned above the chair rail trim 20, and the chair rail cap 22 extends away from the wall 14 to provide noticeable depth to the wainscoting system 10.

Figure 3:
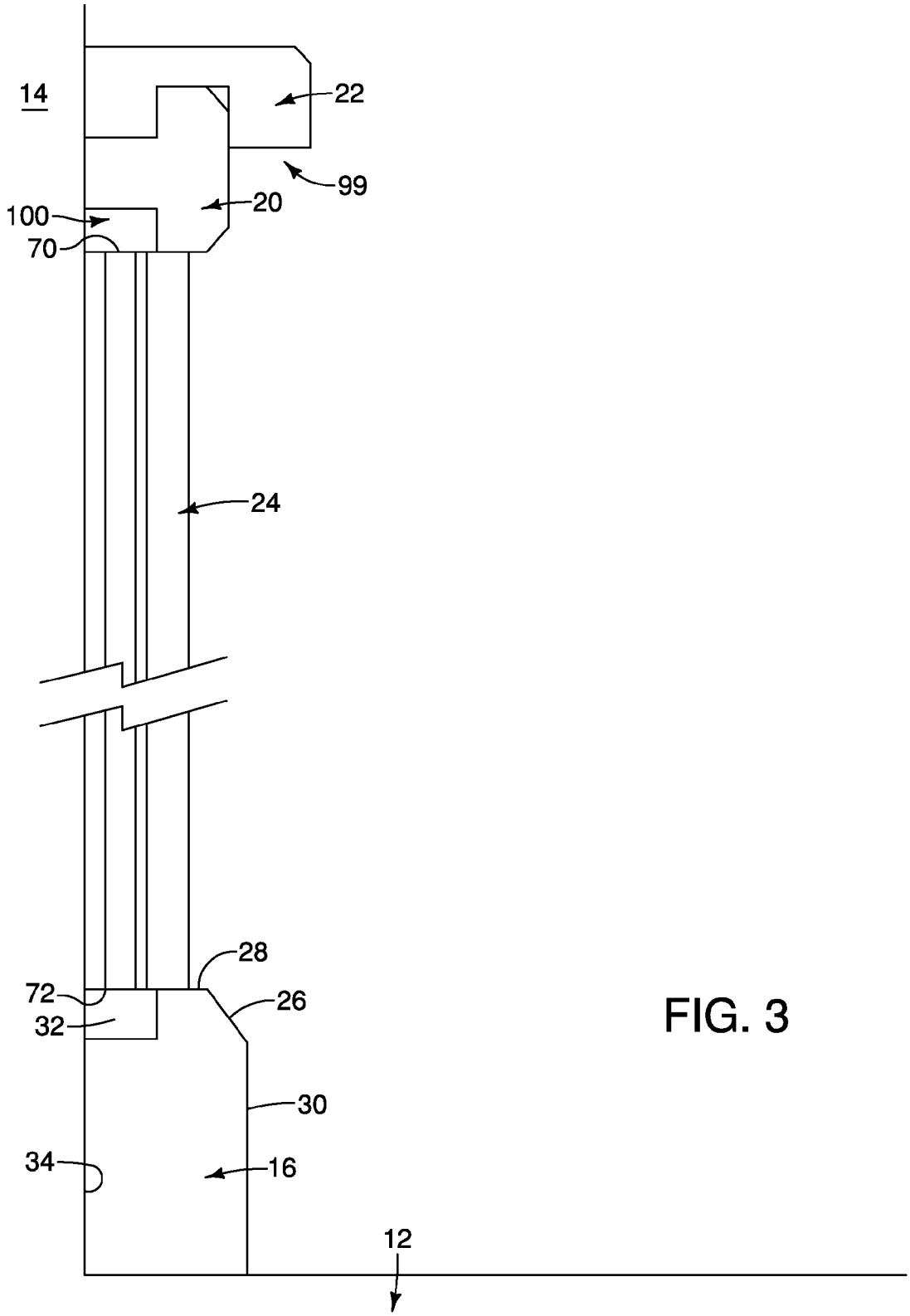
FIG. 3 is cross-sectional view of the wainscoting system shown in FIG. 1 along the line 3-3'.
Figure 4:
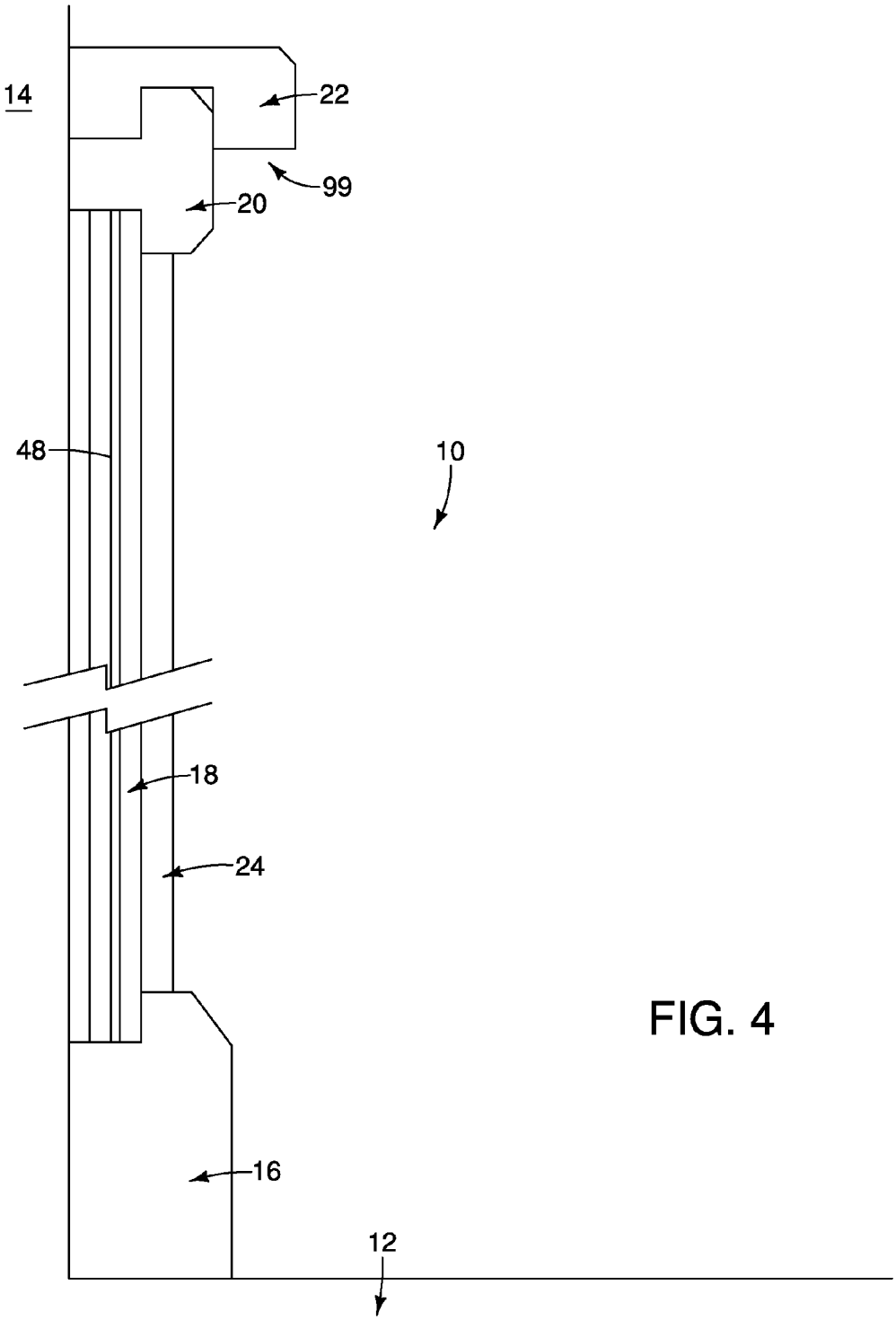
FIG. 4 is a cross-sectional view of the wainscoting system shown in FIG. 1 along the line 4-4'.

As shown in FIGS. 2-4, the lower rail 16 is positioned adjacent to the intersection between the floor 12 and the wall 14. In an embodiment, the lower rail 16 is attached to the wall 14, but it should be understood by one of ordinary skill in the art that the lower rail 16 can also be attached to the floor 12 or to both the floor 12 and the wall 14. The lower rail 16 is an elongated member having a first decorative edge 26. The illustrated embodiment shows the first decorative edge 26 as being a chamfered edge. However, it should be understood by one of ordinary skill in the art that the first decorative edge 26 may be shaped as a bevel, square, rounded, curved, or any compound shape extending between the top surface 28 and the front surface 30 of the lower rail 16. The first decorative edge 26 is directed away from the wall 14 and is formed along the edge of the lower rail 16 opposite the floor 12. In an embodiment, the first decorative edge 26 extends the entire length of the lower rail 16. In another embodiment, the first decorative edge 26 extends along a portion of the length of the lower rail 16.

The lower rail 16 also includes a groove 32 formed into the top surface 28 thereof, as shown in FIGS. 2-4. The groove 32 extends between the top surface 28 and the rear surface 34 of the lower rail 16 and directed toward the wall 14, and the groove 32 is illustrated as being L-shaped. In another embodiment, the groove 32 may have a curved shape between the top and rear surfaces 28, 34. In a further embodiment, the groove 32 is U-shaped and formed only into the top surface 28 of the lower rail 16 and spaced apart from the wall 14. It should be understood by one of ordinary skill in the art that the groove 32 can be formed having any shape sufficient to receive the lower edge of the decorative panels 18.

As illustrated in FIGS. 2 and 4, each decorative panel 18 is configured to be received within the groove 32 formed in the lower rail 16. In the illustrated embodiment, the groove 32 is L-shaped, thereby securing the decorative panel 18 between the groove 32 and the wall 14. In another embodiment, the groove 32 is U-shaped, whereby the decorative panel 18 is spaced apart from the wall 14. It should be understood by one of ordinary skill in the art that the size, shape, and relative location of the groove 32 corresponds to the positioning of the decorative panel 18 relative to the wall 14. The entire lower edge of the decorative panel 18 is received within the groove 32 of the lower rail 16.

Figure 5:
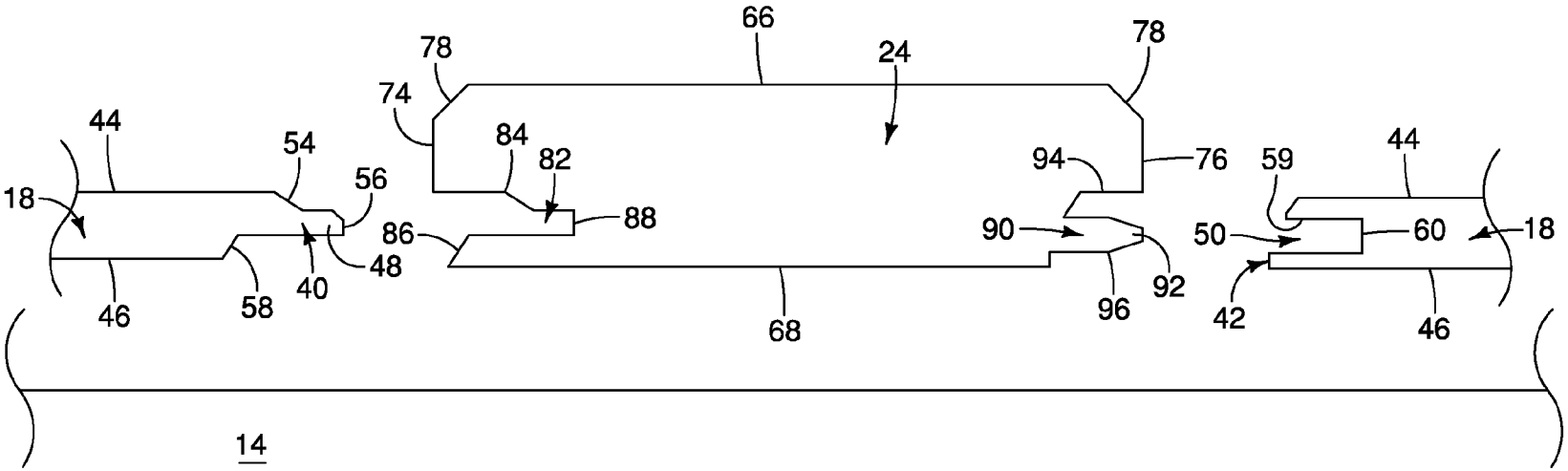
FIG. 5 is a top exploded view of a portion of an exemplary embodiment of a wainscoting system.
Figure 6:
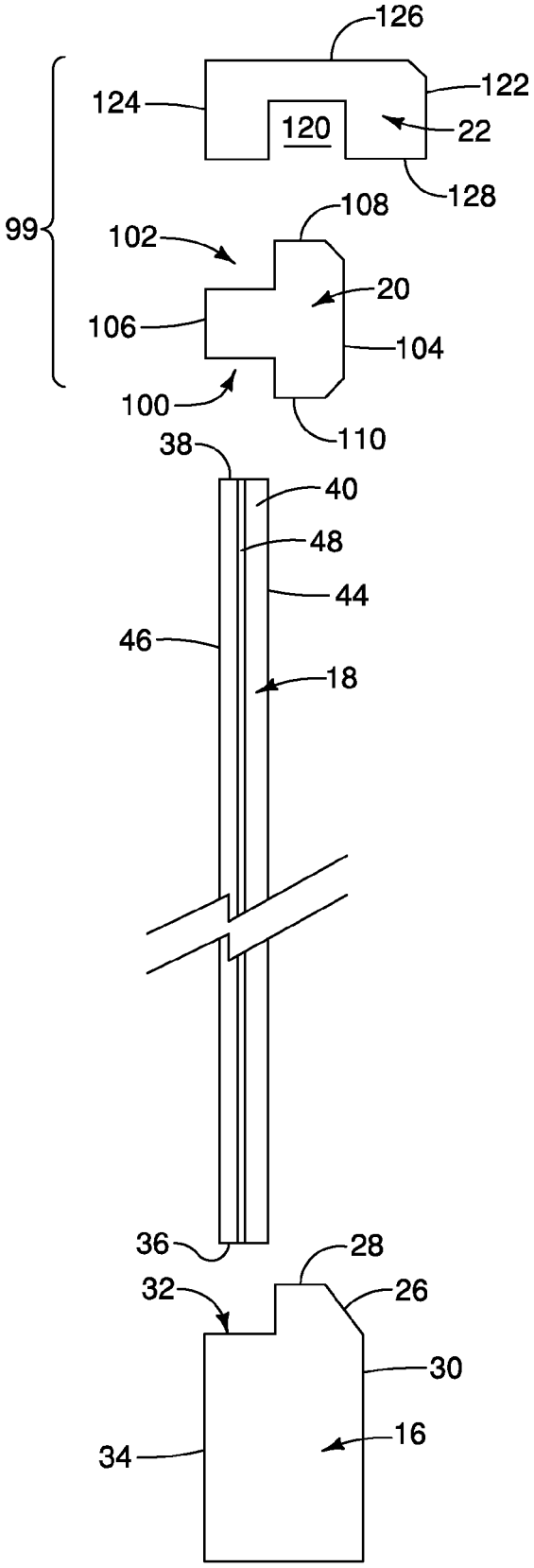
FIG. 6 is a side exploded view of a portion of an exemplary embodiment of a wainscoting system.

An exemplary embodiment of a decorative panel 18 includes a lower edge 36, and upper edge 38, a first side edge 40, a second side edge 42, a front surface 44, a rear surface 46, as shown in FIGS. 2 and 4-5. The decorative panel 18 can be formed as a square member or a rectangular member. In an embodiment, the decorative panel 18 is formed of solid wood, fiber or pressed board, injection molded plastic, extruded plastic or metal, laminated sheet of the same or different materials, or any other material sufficient to provide a durable decorative cover for a wall. In an embodiment, the decorative panel 18 is formed as a homogenous material. In another embodiment, the decorative panel can be formed of one or more materials arranged to provide the decorative panel with beneficial characteristics such as water resistant, fire resistant, fade resistant, scratch and/or dent resistant, or the like. In an embodiment, the front surface 44 of the decorative panel 18 that is directed away from the wall 14 includes a plurality of spaced-apart, vertically oriented indentations 52 (FIG. 1) formed therein. In another embodiment, the front surface 44 is substantially flat. It should be understood by one of ordinary skill in the art that the front surface 44 of the decorative panel 18 may include protrusions, detents, ridges or other decorative elements to provide the decorative panel 18 with a consistent and/or continuous aesthetic appearance.

The first and second side edges 40, 42 of the decorative panel 18 provide for a tongue-and-groove attachment mechanism for engaging adjacent components of the wainscoting system 10, as shown in FIGS. 2 and 4-5. In an embodiment, the tong-and-groove attachment mechanism formed into the first and second side edges 40, 42 are configured to allow the decorative panel 18 to be removably attached to a decorative panel 18 adjacent to each of the first and second side edges 40, 42. In another embodiment, at least another decorative panel 18 is removably attached to either one of the first or second side edges 40, 42 of the decorative panel 18 while the opposing first or second side edge 40, 42 is attached to another member of the wainscoting system 10. In an embodiment, a compound tongue 48 is formed along the entire length of the first side edge 40, as shown in detail in FIG. 5, and a compound groove 50 is formed along the entire length of the second side edge 42. A typical tongue of a tongue-and-groove connecting mechanism is a substantially straight projection having a square or rounded tip with opposing planar surfaces forming the protrusion.

In the exemplary embodiment illustrated in FIG. 5, the compound tongue 48 formed along the first side edge 40 of the decorative panel 18 includes a first compound surface 54 extending between the front surface 44 and the tip 56 and a second compound surface 58 extending from the tip 56 to the rear surface 46. The first and second compound surfaces 54, 58 provide non-planar surfaces that extend from the tip 56 and, in at least one embodiment, extend from the tip 56 to the front and/or rear surface 44, 46 of the decorative panel 18. The tip 56 of the illustrated compound tongue 48 is shown as being substantially flat, or planar, and oriented substantially parallel with respect to the first side edge 40; however, it should be understood by one of ordinary skill in the art that the tip 56 may also be rounded, form a line having a graduated or curved surface extending therefrom, or any other shape that results from manufacturing the compound tongue 48 along the first side edge 40 of the decorative panel 18. The first compound surface 54 extending between the front surface 44 of the decorative panel 18 and the tip 56 includes a plurality of transition surfaces. The first transition surface of the first compound surface 54 extends between the front surface 44 and a planar surface, and a second transition surface extends between the planar surface and the tip 56. The second compound surface 56 extending from the tip 56 to the rear surface 46 of the decorative panel 18 includes a planar surface extending from the tip 56 in an orientation that is substantially parallel to the rear surface 46. A transition surface extends from the end of the planar surface opposite the tip 56 and extends between the planar surface and the rear surface 46.

In the illustrated exemplary embodiment, the first transition surface of the first compound surface 54 is offset from the transition surface of the second compound surface 58, thereby creating a unique shape for the compound tongue 48. The transition surfaces of both the first and second compound surfaces 54, 58 are illustrated as being substantially planar and formed at an angle with respect to an adjacent planar surface; however, it should be understood by one of ordinary skill in the art that these transition surfaces may also be formed as curved surfaces. Additionally, when a compound tongue 48 includes a plurality of transition surfaces between the tip 56 and the front and/or rear surfaces 44, 46, the angle of the slope of the planar transition surfaces can all be formed as the same angle or the angle of the slope of the planar transition surfaces can be formed as different angles. Although the illustrated embodiment of the compound tongue 48 includes a plurality of compound surfaces extending from the tip 56, it should be understood by one of ordinary skill in the art that the compound tongue 48 may include only a single compound surface extending from the tip 56. It should also be understood by one of ordinary skill in the art that when the compound tongue 48 includes a plurality of compound surfaces, the transition surfaces thereof may or may not be aligned on opposing compound surfaces 54.

A typical groove of a tongue-and-groove connecting mechanism includes a U-shaped groove formed into the side edge of a decorative panel, wherein the groove often includes squared, orthogonal edges but may also include slightly rounded edges between the groove and the side edge or slightly rounded edges forming the inner corners of the groove. In the exemplary embodiment illustrated in FIG. 5, the compound groove 50 formed into the second side edge 42 of the decorative panel 18 includes a first compound surface 59 extending between the front surface 44 and the base 60 of the compound groove 50. The base 60 of the illustrated embodiment is formed as a planar surface that is oriented substantially parallel with respect to the second side edge 42, and a planar surface extends orthogonally from the base 60 to the second side edge 42 of the decorative panel 18. The compound groove 50 is shown as having only a single compound surface 59, but it should be understood by one of ordinary skill in the art that the compound groove 50 may include a plurality of compound surfaces extending from the base 60. In addition, the first compound surface 59 of illustrated compound groove 50 extends between the base 60 and the front surface 44 of the decorative panel 18, but it should be understood by one of ordinary skill in the art that the compound surface 59 may extend between the base 60 and the second side edge 42. The first compound surface 59 extends in a substantially planar and orthogonal manner from the base 60, wherein a transition surface extends from the planar surface to the front surface 44 at an angle. The transition surface extends from the planar surface of the first compound surface 59 at an angle greater than 180°. In another embodiment, the transition surface is a curved surface.

The compound tongue 48 and the compound groove 50 provide unique and different engaging mechanisms on opposing side edges 40, 42 of the decorative panel 18. The compound tongue and groove 48, 50 are configured to intimately engage a corresponding compound groove and tongue 50, 48, respectively, on adjacent components of the wainscoting system 10. These corresponding tongue-and-groove shapes allow multiple decorative panels 18 to be joined together to form elongated sections. The compound tongue and groove 48, 50 also simplify the engagement or assembly of the decorative panels 18 by ensuring proper alignment of components because the attachment mechanism on each of the opposing first and second side edges 40, 42 of the decorative panels 18 can only mate with corresponding attachment mechanisms. In the embodiment illustrated in FIGS. 2-5, the compound tongue and groove 48, 50 of the decorative panels 18 are configured to engage with a corresponding compound groove and compound tongue, respectively, formed into a batten 24 positioned between the adjacent decorative panels 18.

An exemplary embodiment of a batten 24 of the wainscoting system 10 is shown in FIGS. 2-3 and 5. The batten 24 is an elongated member configured to extend between the lower rail 16 and the chair rail trim 20. The batten 24 includes a front surface 66, a rear surface 68, an upper edge 70, a lower edge 72, a first side edge 74, and a second side edge 76, wherein the first and second side edges 74, 76 extend between the upper and lower edges 70, 72. In an embodiment, the batten 24 includes opposing decorative edges 78 extending between the front surface 66 and one of the first or second side edges 74, 76. In an embodiment, the decorative edges 78 form a chamfer. In another embodiment, the decorative edges 78 are arcuate, or rounded. It should be understood by one of ordinary skill in the art that the decorative edges 78 of the batten 24 can have any shape sufficient to provide an aesthetic appearance to the batten 24. As shown in FIG. 3, the upper and lower edges 70, 72 of the batten 24 are substantially flat or planar such that the batten 24 is engaged with both the lower rail 16 and the chair rail trim 20 in an abutting manner.

In an embodiment, a compound groove 82 is formed into the first side edge 74 of the batten 24, as shown in FIG. 5. The compound groove 82 is configured to receive a corresponding compound tongue 48 extending from the first side edge 40 of a decorative panel 18. The compound groove 82 of the batten 24 is defined by a first compound surface 84, an opposing second compound surface 86, and a base 88 extending therebetween. The first compound surface 84 includes a first planar surface extending into the thickness of the decorative panel 18 from the first side edge 74, wherein the first planar surface is oriented orthogonally relative to the first side edge 74. A transition surface extends from the first planar surface at an angle, and a second planar surface oriented substantially parallel to the first planar surface extends from the transition surface.

The second planar surface of the first compound surface 84 extends between the transition surface and the base 88, and the second planar surface is oriented substantially orthogonal relative to the base 88. It should be understood by one of ordinary skill in the art that the sloped angle of the transition surface of the first compound surface 84 should correspond to the angle of the first transition surface of the first compound surface 54 of the compound tongue 48 of the decorative panel 18. Although the base and the second planar surface of the first compound surface 84 of the compound groove 82 is shown as being oriented at a right angle, it should be understood by one of ordinary skill in the art that the base 88 and the first compound surface 84 may include a slightly curved surface extending therebetween due to the method of manufacturing but the overall shape of the compound groove 82 should closely correspond to the shape of the compound tongue 48 of the decorative panel 18. The second compound surface 86 of the compound groove 82 includes a first planar surface extending orthogonally relative to the base 88 and a transition surface extending between the first planar surface 86*a* and the rear surface 68 of the batten 24. While the transition surface of the second compound surface 86 is shown as angled and planar, it should be understood by one of ordinary skill in the art that the transition surface may also be curved or have another shape. The illustrated embodiment of the compound groove 82 formed into the first side edge 74 of the batten 24 includes two opposing compound surfaces 84, 86, but it should be understood by one of ordinary skill in the art that compound groove 82 may also be defined as having only a single compound surface. Further, the transition surfaces of the opposing compound surfaces 84, 86 may be aligned or offset relative to each other.

The batten 24 further includes a compound tongue 90 formed into the second side edge 76 thereof, as shown in FIG. 5. The compound tongue 90 is defined by a first compound surface 94 formed into the second side edge 76 and extending to the tip 92 as well as a second compound surface 96 extending from the tip 92 to the rear surface 68 of the batten 24. The first compound surface 94 includes a first planar surface extending substantially perpendicular relative to the second side edge 76 of the batten 24. A first transition surface extends from the end of the first planar surface in a direction away from the second side edge 76 at an angle relative to the first planar surface. A second planar surface extends from the first transition surface in a direction toward the second side edge 76 and oriented substantially parallel to the first planar surface. A second transition surface extends from the end of the second planar surface to the tip 92, wherein the second transition surface is oriented at an angle relative to the second planar surface. The second compound surface 96 includes a first transition surface extending from the tip 92 at an angle relative thereto. A planar surface extends from the end of the first transition surface in a linear manner away from the second side edge 76, wherein the planar surface of the second compound surface 96 is substantially parallel to the second planar surface of the first compound surface 94. A second transition surface extends from the planar surface to the rear surface 68 of the batten 24, wherein the second transition surface is oriented orthogonally relative to both the planar surface and the rear surface 68. The compound tongue 90 of the batten 24 is configured to be received within the compound groove 50 formed into the adjacent decorative panel 18 to provide an engaging connection therebetween.

The batten 24 and decorative panels 18 are connected such that the upper edge 70 of the batten 24 is offset relative to the upper edge 38 of each decorative panel 18 engaged with the batten 24 and the lower edge 72 of the batten 24 is offset relative to the lower edge 40 of each decorative panel 18 engaged with the batten. As such, the upper and lower edges 38, 40 of the decorative panels 18 extend beyond the corresponding upper and lower edges 70, 72 of the batten 24. The decorative panels 18 and battens 24 are positioned adjacent to the wall 14 such that the lower edge 40 of each decorative panel 18 is disposed within the groove 32 of the lower rail 16 and the upper edge 38 of each decorative panel 18 is disposed within a lower groove 100 formed in the chair rail trim 20, as shown in FIG. 4, while the upper and lower edges 70 of the batten 24 contact the top surface 28 of the lower rail 16 and the lower surface 110 of the chair rail trim 20, respectively. When positioned in this manner, the front surface 66 of the batten 24 is offset from the front surface 44 of the decorative panel 18 such that the front surface 66 of the batten 24 extends away from the wall 14 a greater distance than the front surface 44 of the decorative panel 18.

In an exemplary embodiment, the chair rail assembly 99 of the wainscoting system 10 includes a chair rail trim 20 and a separate chair rail cap 22 that is engaged with the chair rail trim 20, as shown in FIGS. 2-4. In another embodiment (not shown), the chair rail assembly 99 is a single member in which the chair rail trim 20 and the chair rail cap 22 are integrally formed together. In the embodiment illustrated in FIGS. 2-4 and 6, the chair rail trim 20 is an elongated member that is defined by a lower groove 100, an upper groove 102, a front surface 104, a rear surface 106, an upper surface 108, and a lower surface 110. The lower groove 100 is an L-shaped groove extending between the lower surface 110 and the rear surface 106, and the upper groove 102 is likewise an L-shaped groove extending between the upper surface 108 and the rear surface 106. The rear surface 106 is configured to be positioned immediately adjacent to the wall 14 in an abutting manner. The lower groove 100 is adapted to receive the upper edge 38 of the decorative panel 18, and the upper groove 102 is adapted to receive a portion of the chair rail cap 22. The chair rail trim 20 is configured to be attached to the wall 14 so as to secure the upper edge 38 of the decorative panel 18 between the lower groove 100 and the wall 14, and thereby positively securing the decorative panel 18 between the chair rail trim 20 and the lower rail 16. As shown in FIG. 3, the upper surface 70 of the batten 24 is configured to contact the lower surface 110 of the chair rail trim 20, thereby securing the batten 24 between the chair rail trim 20 and the lower rail 16. The front surface 104 of the chair rail trim 20 is configured to extend away from the wall a greater distance than both the front surface 44 of the decorative panel 18 as well as the front surface 66 of the batten 24.

A portion of the chair rail cap 22 is adapted to be received within the upper groove 102 of the chair rail trim 20, as shown in FIGS. 2-4 and 6, and similarly, the upper surface 108 of the chair rail trim 20 is received within the groove 120 of the chair rail cap 22. The chair rail cap 22 is an elongated member and has a front surface 122, rear surface 124, upper surface 126, and lower surface 128, wherein the groove 120 is formed into the lower surface 128. The rear surface 124 is positioned immediately adjacent to the wall 14 in an abutting manner when assembled, and the rear surface 124 is attachable to the wall 14 to positively position the chair rail cap 22. It should be understood by one of ordinary skill in the art that the groove 120 of the chair rail cap 22 should be sized and shaped to correspond to the portion of the chair rail trim 120 received therein so as to form a secure fit therebetween without having excessive relative movement.

When assembling the wainscoting system 10, the lower rail 16 is secured to the wall 14 such that the lower rail 16 is also abutting or slightly spaced apart from the floor 12. The lower rail 16 provides a base upon which the remaining members are supported, but the lower rail 16 also provides alignment of the lower portion of the decorative panels 18 and battens 24. Once the lower rail 16 is secured to the wall 14, at least one decorative panel 18 and at least one batten 24 are connected together to form an elongated section that will extend along at least a portion of the length of the wall 14. The section of decorative panels 18 and battens 24 are positively located in an abutting relationship with the wall 14 by inserting the lower edge 36 of the decorative panel 18 into the groove 32 of the lower rail 16 such that the lower edge 72 of the battens 24 contact the top surface 28 of the lower rail 18. The rear surface 46 of the decorative panels 18 and the rear surface 68 of the battens 24 are positioned in an abutting manner relative to the wall 14. In an embodiment, the battens 24 and decorative panels 18 are attached to the wall 14. In another embodiment, the battens 24 and the decorative panels 18 are not attached to the wall but are instead maintained in a substantially abutting relationship with the wall 14 by way of the lower rail 16 and the chair rail assembly 99.

Once the decorative panels 18 and the battens 24 have been positioned adjacent to the lower rail 16, the chair rail assembly 99 is positioned over the decorative panels 18 and the battens 24 such that the upper edge 70 of the battens 24 contact the lower surface 100 of the chair rail trim 20 and the upper edge 38 of the decorative panels 18 is received within the lower groove 100 of the chair rail trim 20. The chair rail assembly 99 is then secured to the wall 99, thereby ensuring that the entire system 10 is secured to the wall 16.

The wainscoting system 10 shown in FIGS. 1-6 illustrate an exemplary embodiment in which the system extends vertically up a wall to the general height of a chair back in which the wainscoting system 10 included only a single horizontal row of decorative panels 18. In another exemplary embodiment, shown in FIGS. 7-8, the wainscoting system 10 includes a plurality of horizontal rows of decorative panels 18. The plurality of rows of decorative panels 18 can be arranged such that the height of the wainscoting system 10 having a plurality of rows extends vertically up a wall to the general height of a chair back, or the decorative panels 18 can be arranged such that the height of the wainscoting system 10 having a plurality of rows extends vertically up a wall any other distance. In yet another exemplary embodiment, shown in FIG. 9, the wainscoting system 10 includes a plurality of horizontal rows of decorative panels 18 such that the wainscoting system extends vertically up the wall 14 from the floor 12 to the ceiling 13. It should be understood by one of ordinary skill in the art that the manner of assembly and securing of the adjacent components of the wainscoting system 10 in each embodiment is the same as discussed above.

Figure 7:
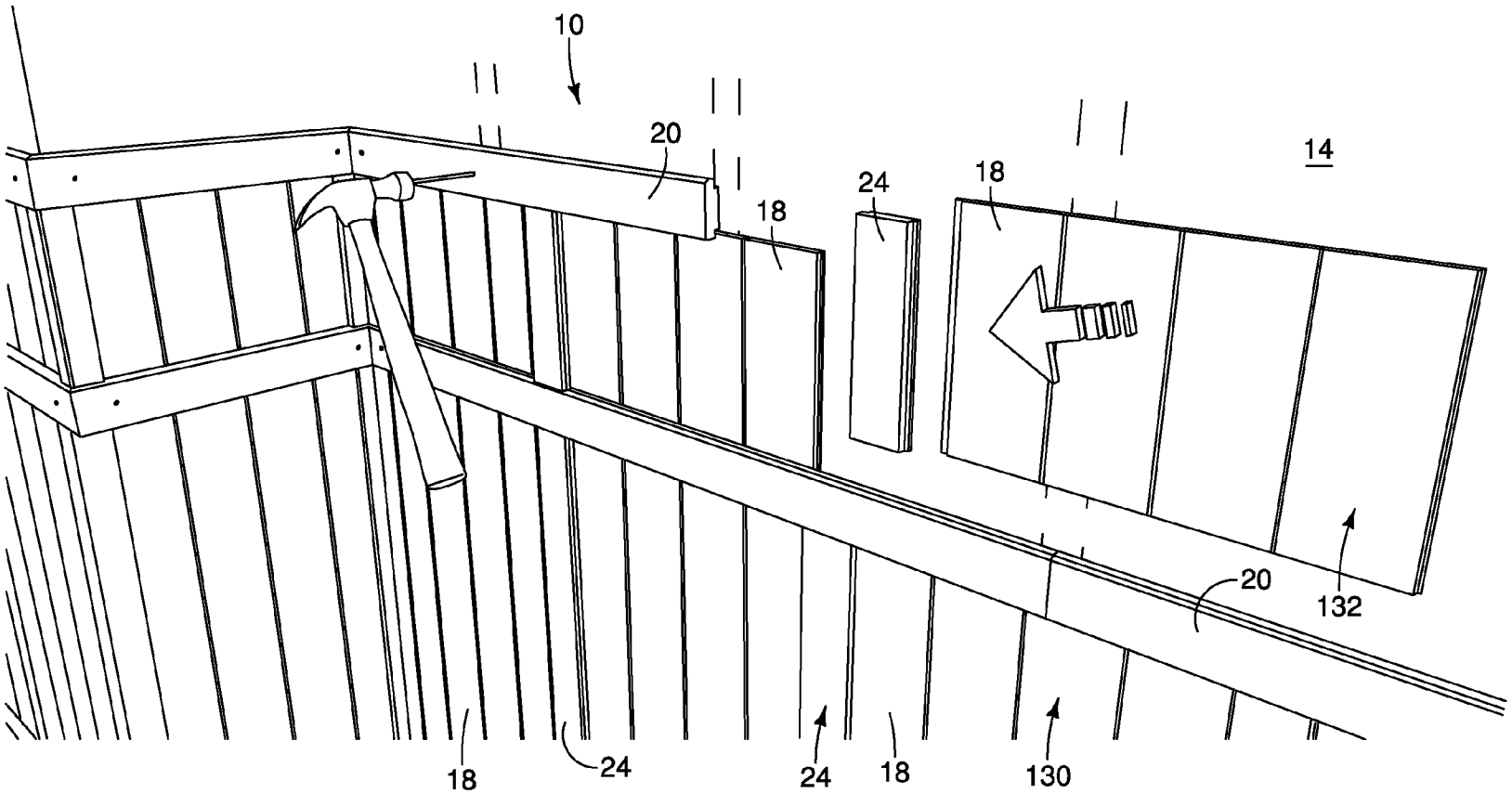
FIG. 7 is a perspective view of another exemplary embodiment of a wainscoting system.
Figure 8:
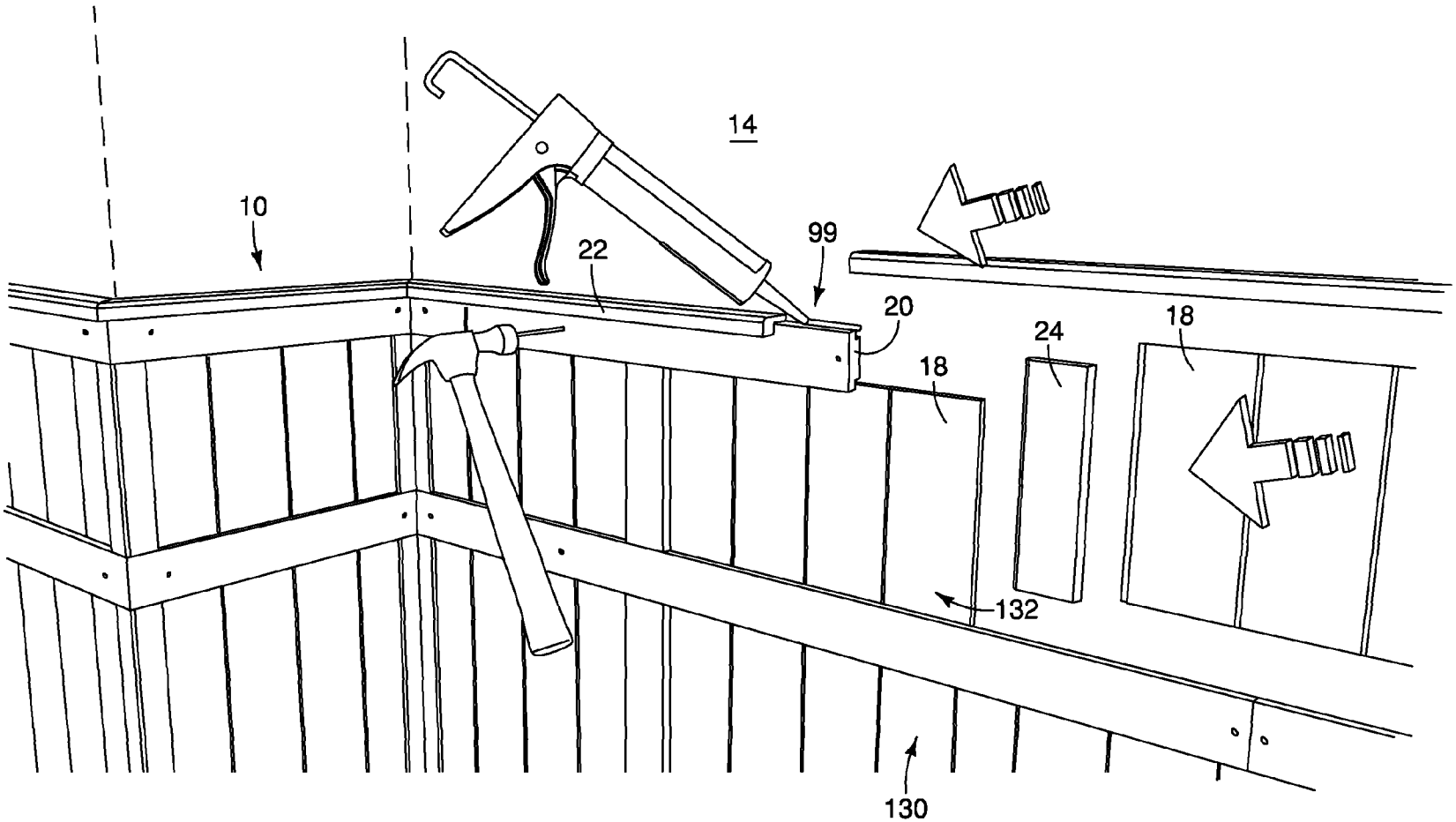
FIG. 8 is a perspective view of the wainscoting system shown in FIG. 7.

Referring to FIGS. 7-8, the wainscoting system 10 includes a first, or lower row 130 of decorative panels 18, wherein each decorative panel(s) 18 is separated from an adjacent decorative panel(s) 18 by way of a batten 24. A chair rail trim 20 is positioned across the top of the first row 130 of decorative panels 18 and secured to the wall 14. However, instead of attaching a chair rail cap 22 to the chair rail trim 20, a second row 132 of decorative panels 18 are positioned adjacent to the first row 130 of decorative panels 18. The lower edge 36 of each decorative panel 18 in the second row 132 is received within the upper groove 102 of the chair rail trim 20 that is oriented substantially parallel relative to the floor 12 and also receives the upper edge 38 of the decorative panels 18 of the first row 130. A batten 24 is then positioned between horizontally adjacent decorative panels 18 or decorative panels 18 attached to each other, thereby forming the second row 132 of decorative panels 18. A second chair rail trim 20 is then positioned adjacent to the upper edge 38 of each decorative panel 18 and the upper edge 70 of each batten 24 in the second row 132, wherein the lower groove 100 of the chair rail trim 20 receives the upper edge 38 of the decorative panels 18 in the second row 132. This chair rail trim 20 is then secured to the wall 14 by way of a fastening mechanism such as glue, screws, nails, or any other fastening mechanism for providing a positive connection between the chair rail trim 20 and the wall 14. It should be understood by one of ordinary skill in the art that any number of rows of decorative panels 18 and battens 24 can be combined in a wainscoting system 10. It should also be understood by one of ordinary skill in the art that the relative height of each row of decorative panels 18 and battens 24 may either be the same or, as shown in FIGS. 7-8, different.

In the exemplary embodiment illustrated in FIGS. 7-8, a chair rail cap 22 is secured to the chair rail trim 20 in the same manner as discussed above. The chair rail cap 22 can be secured to the chair rail trim 20 by way of glue, screws, nails, or any other fastening mechanism. It should also be understood by one of ordinary skill in the art that the chair rail cap 22 may also engage the chair rail trim 20 yet be fixedly secured to the wall 14.

Figure 9:
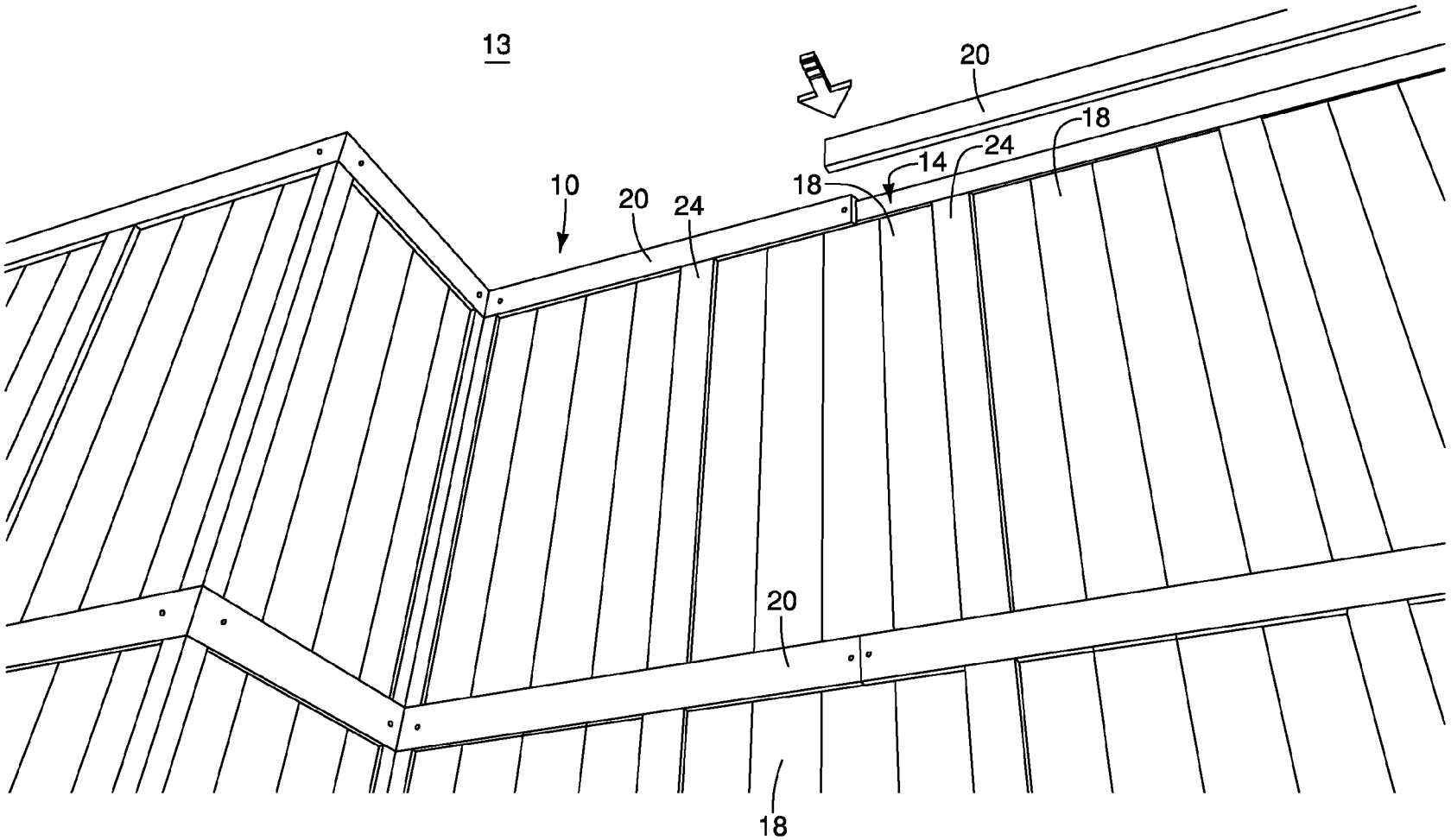
FIG. 9 is a perspective view of yet another exemplary embodiment of a wainscoting system.
Figure 10:
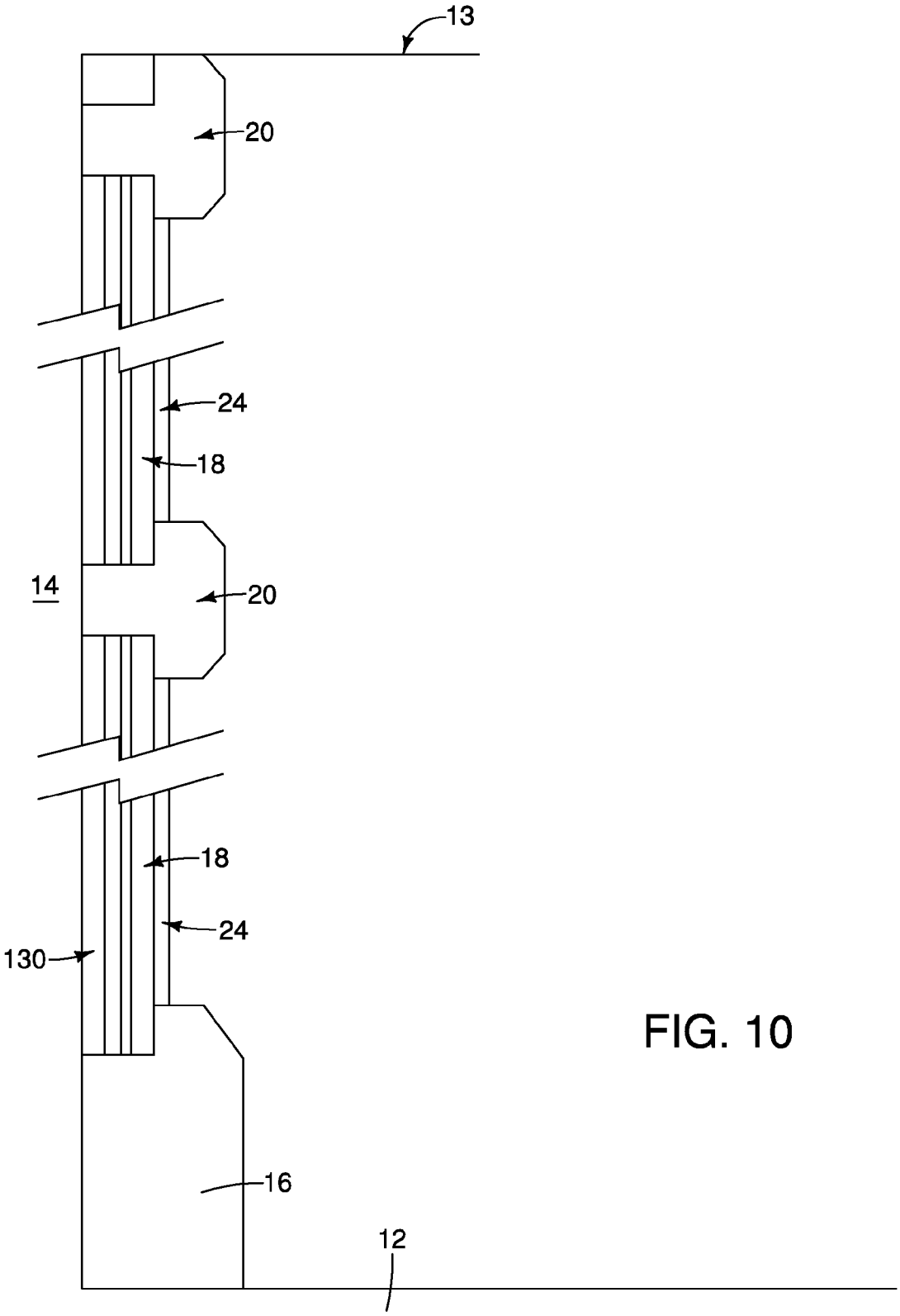
FIG. 10 is a side view of the wainscoting system shown in FIG. 9.

Referring to the exemplary embodiment of the wainscoting system 10 illustrated in FIG. 9, a plurality of horizontal rows of decorative panels 18 and battens 24 are combined to extend to the ceiling 13. Similar to the second row 132 of decorative panels 18 and battens 24 discussed above with respect to the embodiment shown in FIGS. 7-8, the final, or upper row of decorative panels 18 and battens 24 are positioned above and engaged with a chair rail trim 20. The decorative panels 18 and battens 24 are assembled to form the upper row. However, the upper row of decorative panels 18 and battens 24 may need to be cut so as to cover the remaining vertical portion of the wall 14 while allowing sufficient room for a chair rail trim 20 to be positioned along the upper edge of the decorative panels 18 and the upper edge of the battens 24. In an embodiment, the chair rail trim 20 is positioned such that the upper surface 108 contacts the ceiling 13 and the upper edge 38 of the decorative panels 18 of the upper row are received in the lower groove 100. The chair rail trim 20 can then be secured to the wall 14 and/or the ceiling 13, thereby providing a finished upper edge to the wainscoting system 10 that covers the entire height of a wall 14. In an embodiment, the battens 24 of each adjacent row are vertically aligned. In another embodiment, the battens 24 of each adjacent row are offset relative to the battens of the lower row.

While preferred embodiments of the present invention have been described, it should be understood that the present invention is not so limited and modifications may be made without departing from the present invention. The scope of the present invention is defined by the appended claims, and all devices, processes, and methods that come within the meaning of the claims, either literally or by equivalence, are intended to be embraced therein.

What is claimed is:

1. A wainscoting system comprising:

a lower rail fixedly attached to a wall, wherein said lower rail includes a groove;

a chair rail trim fixedly attached to said wall, wherein said chair rail trim is spaced apart from said lower rail, said chair rail trim includes a groove;

at least two decorative panels, each decorative panel having a compound tongue formed into a first side edge of said decorative panel and a compound groove formed into an opposing second side edge of said decorative panel, wherein said compound tongue of each decorative panel is defined by a tip and at least one compound surface extending from said tip, wherein said first side edge is shaped differently than said second side edge;

at least one batten, wherein one of said at least one batten is positioned between a pair of said decorative panels, said batten having a compound groove formed into a first side edge of said batten and a compound tongue formed into an opposing second side edge of said batten;

wherein said compound tongue of one of said pair of decorative panels engages said compound groove of said batten and said compound groove of the other of said pair of decorative panels engages said compound tongue of said batten, and wherein a portion of each of said at least two decorative panels is received within said groove of said lower rail and a portion of each of said at least two decorative panels is received within said groove of said chair rail trim.

2. The wainscoting system of claim 1, wherein each of said at least one batten abuts a top surface of said lower rail and abuts a lower surface of said chair rail trim.

3. The wainscoting system of claim 1, wherein a chair rail cap is attached to said chair rail trim.

4. The wainscoting system of claim 1, wherein said compound tongue of said at least one batten includes at least one compound surface.

5. The wainscoting system of claim 1, wherein said compound groove of each of said decorative panels and said compound groove of said batten include at least one compound surface.

6. The wainscoting system of claim 1, wherein said compound surface defining at least a portion of said compound tongue of said panels includes at least one transition surface.

7. The wainscoting system of claim 1, wherein said compound surface defining at least a portion of said compound tongue of said panels includes at least one planar surface and at least one transition surface.

8. A wainscoting system for covering a portion of a wall, said wainscoting system comprising:

a lower rail fixedly attached to a wall having a groove formed into an upper surface thereof;

a plurality of decorative panels, wherein at least a portion of each of said plurality of decorative panels is received in said groove of said lower rail, each of said plurality of decorative panels includes a first side edge and a second side edge, wherein said first side edge is shaped differently than said second side edge;

at least one batten operatively engaging two of said plurality of decorative panels; and a chair rail trim fixedly attached to said wall having a groove formed into a lower surface thereof, wherein at least a portion of each of said plurality of decorative panels is received in said groove of said chair rail trim;

wherein a compound tongue formed in said batten is engageable with a corresponding compound groove formed in one of said plurality of decorative panels, and a compound groove formed in said batten is engageable with a corresponding compound tongue formed in another of said plurality of decorative panels; and wherein said compound tongue formed in said decorative panels is formed of a tip, a first side surface extending from said tip, and a second side surface extending from said tip, wherein at least one of said first and second side surfaces is a compound surface that includes at least one transition surface.

9. The wainscoting system of claim 8, wherein said batten abuts both of said upper surface of said lower rail and said lower surface of said chair rail trim.

10. The wainscoting system of claim 8, wherein said compound tongue formed in said batten includes at least one compound surface.

11. The wainscoting system of claim 8, wherein said compound groove formed in said batten and said compound groove formed in said decorative panels each includes at least one compound surface.

12. The wainscoting system of claim 8, wherein said compound groove formed in each of said decorative panels includes a base, a planar surface extending from said base to a side edge of said decorative panel, and a compound surface extending from said base to a front surface of said decorative panel.

13. The wainscoting system of claim 12, wherein said compound surface partially defining said compound groove includes at least one transition surface.

14. The wainscoting system of claim 8, wherein said compound tongue formed in said at least one batten includes a tip, a first compound surface extending from said tip to a side edge of said batten, and a second compound surface extending from said tip to a rear surface of said batten.

15. The wainscoting system of claim 14, wherein said compound groove formed in each of said at least one batten includes a base, a first compound surface extending from said base to a side edge of said batten, and a second compound surface extending from said base to a rear surface of said batten.

16. A wainscoting system for covering a portion of a wall comprising:

a lower rail fixedly attached to a wall having a groove formed into an upper surface thereof;

a first row of decorative panels, wherein at least a portion of each of said plurality of decorative panels of said first row is received in said groove of said lower rail, each of said decorative panels of said first row includes a first side edge and a second side edge, wherein said first side edge is shaped differently than said second side edge;

at least one batten operatively engaging two of said plurality of decorative panels of said first row;

a first chair rail trim fixedly attached to said wall having a lower groove formed into a lower surface thereof and an upper groove formed into an upper surface thereof, wherein at least a portion of each of said plurality of decorative panels of said first row is received in said lower groove of said first chair rail trim;

a second row of decorative panels, wherein at least a portion of each of said plurality of decorative panels of said second row is received in said upper groove of said first chair rail trim, each of said decorative panels of said second row includes a first side edge and a second side edge, wherein said first side edge is shaped differently than said second side edge; and a second chair rail trim fixedly attached to said wall having a lower groove formed into a lower surface thereof, wherein at least a portion of each of said plurality of decorative panels of said second row is received in said lower groove of said second chair rail trim;

at least one batten operatively engaging two of said plurality of decorative panels of said second row;

wherein a compound tongue formed in each of said battens is engageable with a corresponding compound groove formed in one of said plurality of decorative panels adjacent thereto, and a compound groove formed in each of said battens is engageable with a corresponding compound tongue formed in another of said plurality of decorative panels adjacent thereto;

wherein said compound tongue formed in said decorative panels includes a tip and at least one compound surface extending from said tip.

17. The wainscoting system of claim 16, wherein a chair rail cap is attached to said second chair rail.

18. The wainscoting system of claim 16, wherein said compound groove formed in said battens includes at least one compound surface.

19. The wainscoting system of claim 16, wherein said compound surface of said compound tongue formed in said decorative panels includes at least one transition surface.

* * * * *